US009042753B2

(12) United States Patent
Okada

(10) Patent No.: US 9,042,753 B2
(45) Date of Patent: May 26, 2015

(54) IMAGE FORMING APPARATUS

(75) Inventor: Noriyuki Okada, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 67 days.

(21) Appl. No.: 13/597,603

(22) Filed: Aug. 29, 2012

(65) Prior Publication Data

US 2013/0058669 A1 Mar. 7, 2013

(30) Foreign Application Priority Data

Sep. 1, 2011 (JP) ..... 2011-190721

(51) Int. Cl.
*G03G 15/00* (2006.01)
*G03G 15/08* (2006.01)
*G03G 15/16* (2006.01)

(52) U.S. Cl.
CPC ..... *G03G 15/5058* (2013.01); *G03G 15/0853* (2013.01); *G03G 15/0893* (2013.01); *G03G 15/0855* (2013.01)

(58) Field of Classification Search
CPC ..... G03G 15/5058; G03G 15/0827; G03G 15/0877; G03G 2215/0866; G03G 2215/0869; G03G 15/1645
USPC ..... 399/49, 53, 258, 260
See application file for complete search history.

(56) References Cited

U.S. PATENT DOCUMENTS

| | | | | |
|---|---|---|---|---|
| 5,296,903 | A * | 3/1994 | Suzuki et al. | 399/66 |
| 5,937,229 | A * | 8/1999 | Walgrove et al. | 399/66 |
| 6,160,972 | A * | 12/2000 | Shimazu et al. | 399/66 |
| 2010/0247125 | A1* | 9/2010 | Akita | 399/49 |

FOREIGN PATENT DOCUMENTS

| | | | |
|---|---|---|---|
| JP | 5-150653 | A | 6/1993 |
| JP | 10-39608 | A | 2/1998 |
| JP | 2005-164779 | A | 6/2005 |
| JP | 2007-101755 | A | 4/2007 |

OTHER PUBLICATIONS

Machine translation of Mochizuki JP 2005-164779.*

Hauser, O.G., Encyclopedia of Imaging Science and Technology, John Wiley & Sons, Inc, § 6 ¶ 4 (2002).*

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

An image forming apparatus includes an image forming portion; a supplying device for supplying a toner; a transfer device capable of transferring the toner image from the image forming portion onto a toner image receiving member; a first detecting portion for detecting a transfer current of the transfer device; a second detecting portion for detecting information on a toner amount of the transferred toner image; and a controller for controlling, during non-image formation, a supplying operation of the supplying device on the basis of a detection result of the first detecting portion when a toner image for measurement formed at the image forming portion is transferred by the transfer device at a transfer voltage lower than a discharge start voltage and on the basis of a detection result when the toner image for measurement transferred on the toner image receiving member is detected by the second detection portion.

4 Claims, 11 Drawing Sheets

(a)

(b)

IMAGE FORMING APPARATUS

FIELD OF THE INVENTION AND RELATED ART

The present invention relates to an image forming apparatus in which an electrostatic latent image (electrostatic image) on an image bearing member is developed with a charged toner into a toner image by a developing device and then the toner image is transferred onto a recording material through an electrical transfer step. Specifically, the present invention relates to control for accurately estimate a toner charge amount in the developing device by using a toner image transfer phenomenon.

The image forming apparatus in which the electrostatic latent image formed on the image bearing member is developed with the charged toner into the toner image by the developing device and then the recording material on which the toner image is transferred through the electrical transfer step is heated and pressed to fix an image on the recording material has been widely used. Further, an image forming apparatus in which the toner image formed on the image bearing member is transferred onto a recording material by using a conveying member (intermediary transfer member or recording material conveying member) has also been widely used.

A density of the image, on the recording material, obtained by developing the electrostatic image depends on a density of the toner deposited on the electrostatic image formed on the image bearing member, and the density of the toner deposited on a certain electrostatic image depends on an average quantity of electricity of toner particles contained in the developing device. The average quantity of electricity of the toner particles contained in the developing device is represented by a toner charge amount Q/M which is the quantity of electricity per unit weight of the toner. Therefore, in order to maintain a density of an output image at a constant level, it is essential to keep the toner charge amount Q/M in the developing device at a constant level.

The toner charge amount Q/M in the developing device using a two-component developer is increased in general with an increase in frequency of friction of the toner against a carrier in the developing device. Therefore, the toner charge amount Q/M is decreased when the toner is supplied into the developing device, and is increased when the toner is consumed by image formation. For this reason, control in which an amount of the toner supplied depending on a degree of the toner consumption is adjusted to keep the toner charge amount Q/M at a constant level has been conventionally employed (Japanese Laid-Open Patent Application (JP-A) Hei 10-039608).

In JP-A Hei 10-039608, an image forming apparatus in which the toner image formed on the image bearing member is transferred onto a recording material carried on a recording material conveyance belt is described. In this image forming apparatus, an amount of the toner consumed every image formation is obtained by a video count, and then the toner in the obtained amount is supplied from a developer supplying device to the developing device. Then, a patch toner image for estimating the toner charge amount Q/M is periodically formed on the image bearing member, and a toner density of the patch toner image on the image bearing member is measured by an optical sensor and then a measurement result is fed back to a toner supply amount based on the video count.

In order to constantly reproduce the toner density of the patch toner image obtained by developing the electrostatic image formed under a predetermined condition, the amount of the toner supplied from the developer supplying device was corrected. When the toner density was constant, the toner charge amount Q/M in the developing device was regarded as being kept at the constant level.

In JP-A 2005-164779, use of a transfer voltage higher than a discharge start voltage in order to enhance transfer efficiency when a toner image is transferred from a photosensitive drum onto an intermediary transfer belt is described. The discharge start voltage refers to a transfer voltage at an inflection point where a transfer current passing through a toner image transfer portion is deviated from a proportional relation with a voltage and starts to largely increase when the voltage applied to a transfer roller is changed in a direction in which the voltage is increased.

However, the electrostatic image formed on the image bearing member under a predetermined condition is not always a certain electrostatic image. Due to a temperature and humidity condition of the image bearing member, a temperature characteristic of an electrostatic image forming device (exposure device etc.), and the like, a potential of the electrostatic image can vary even when the certain electrostatic image is formed under the predetermined condition. Further, even when the certain electrostatic image is formed on the image bearing member, the toner density of the patch toner image developed from the electrostatic image varies depending on a voltage fluctuation of the developing device, a change in development efficiency, and the like.

Therefore, even when the toner density of the patch toner image obtained by developing, under a predetermined condition, the electrostatic image formed under a predetermined condition is apparently reproduced at a constant level, there was a possibility that the toner charge amount was largely deviated from a design range. When the toner charge amount is deviated from the design range, even when the image density is reproduced with density gradation of the patch toner image, there is a possibility that the first density is not accurately reproduced with density gradation somewhat different from that of the patch toner image. When the toner charge amount is below the design range, there also arises a problem that a degree of toner scattering around the developing device is increased. When the toner charge amount exceeds the design range, a problem that a transfer efficiency is lowered and thus a reproducibility of the image density is lowered also occurs.

SUMMARY OF THE INVENTION

A principal object of the present invention is to provide an image forming apparatus capable of estimating a toner charge amount Q/M directly more than a conventional image forming apparatus in a state in which an error with respect to disturbance is small, capable of suppressing a fluctuation in toner charge amount Q/M in a developing device, and capable of enhancing a reproducibility of an output image.

According to an aspect of the present invention, there is provided an image forming apparatus, comprising: an image forming portion for forming a toner image; a supplying device for supplying a toner to the image forming portion; a transfer device capable of transferring the toner image from the image forming portion onto a toner image receiving member; a first detecting portion for detecting a transfer current of the transfer device; a second detecting portion for detecting information on a toner amount of the toner image transferred on the toner image receiving member; and a controller for controlling, during non-image formation, a supplying operation of the supplying device on the basis of a detection result of the first detecting portion when a toner image for measurement formed at the image forming portion is transferred by the transfer device at a transfer voltage lower than a discharge start voltage and on the basis of a detection result when the toner image for measurement transferred on the toner image receiving member is detected by the second detection portion.

These and other objects, features and advantages of the present invention will become more apparent upon a consideration of the following description of the preferred embodiments of the present invention taken in conjunction with the accompanying drawings.

Figure 5:
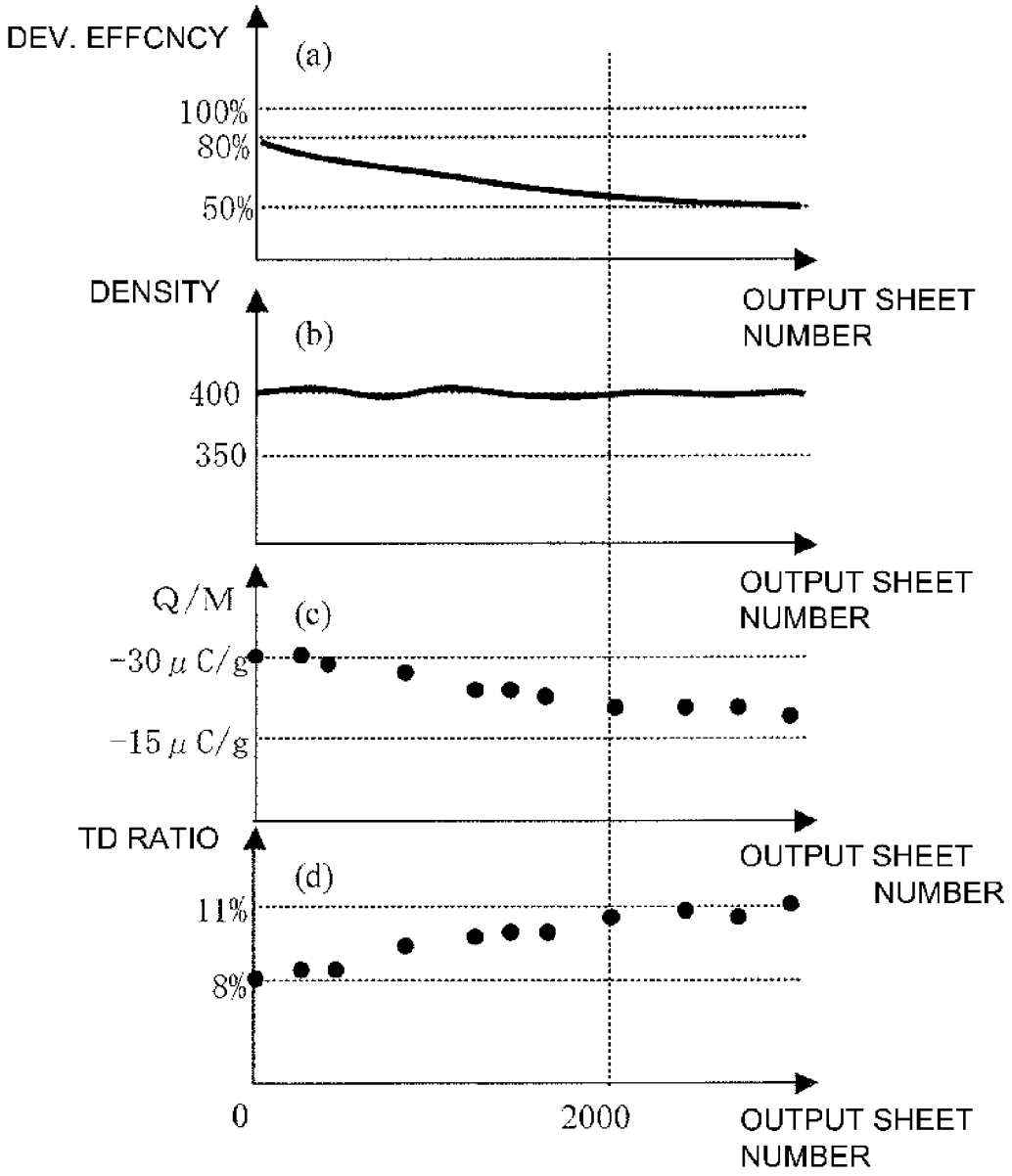

Parts (a) to (d) of FIG. 5 are graphs for illustrating a change in toner charge amount Q/M in control in Comparative Embodiment.

Figure 6:
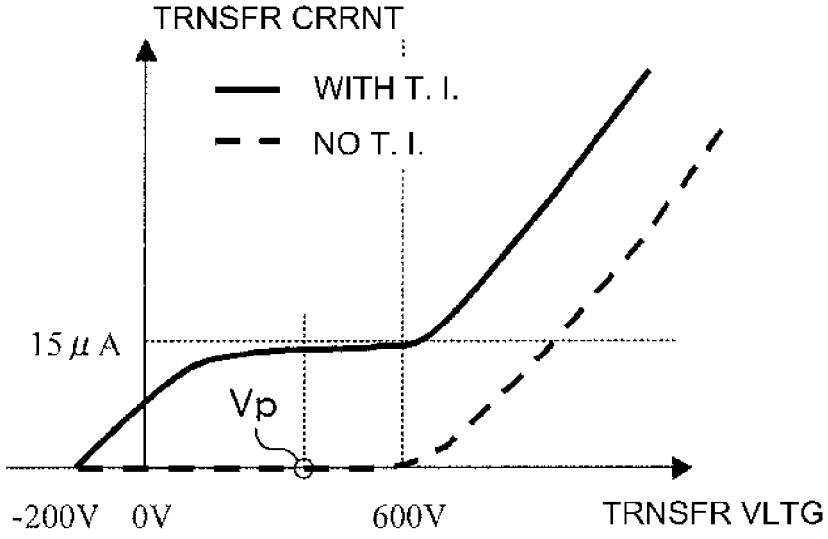
Figure 6:
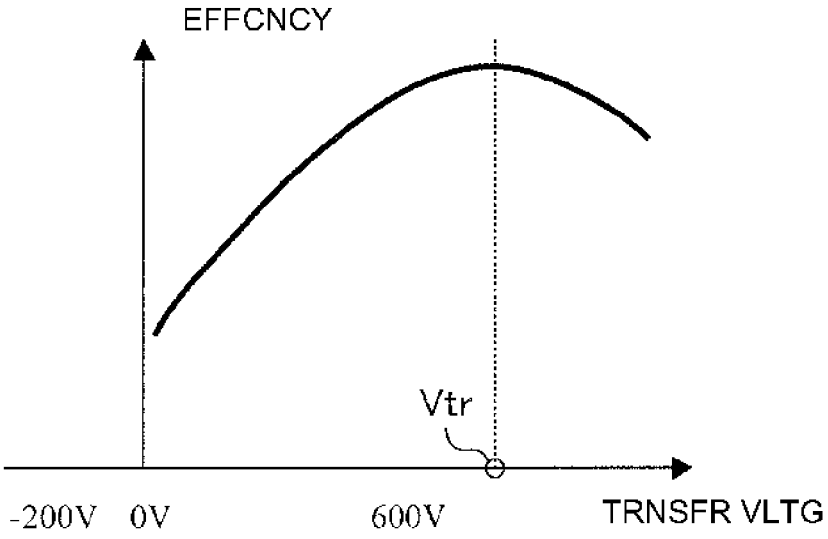

Parts (a) and (b) of FIG. 6 are graphs for illustrating a relationship between a transfer voltage and a transfer current applied to a transfer roller and a relationship between the transfer voltage and a transfer efficiency.

Figure 7:
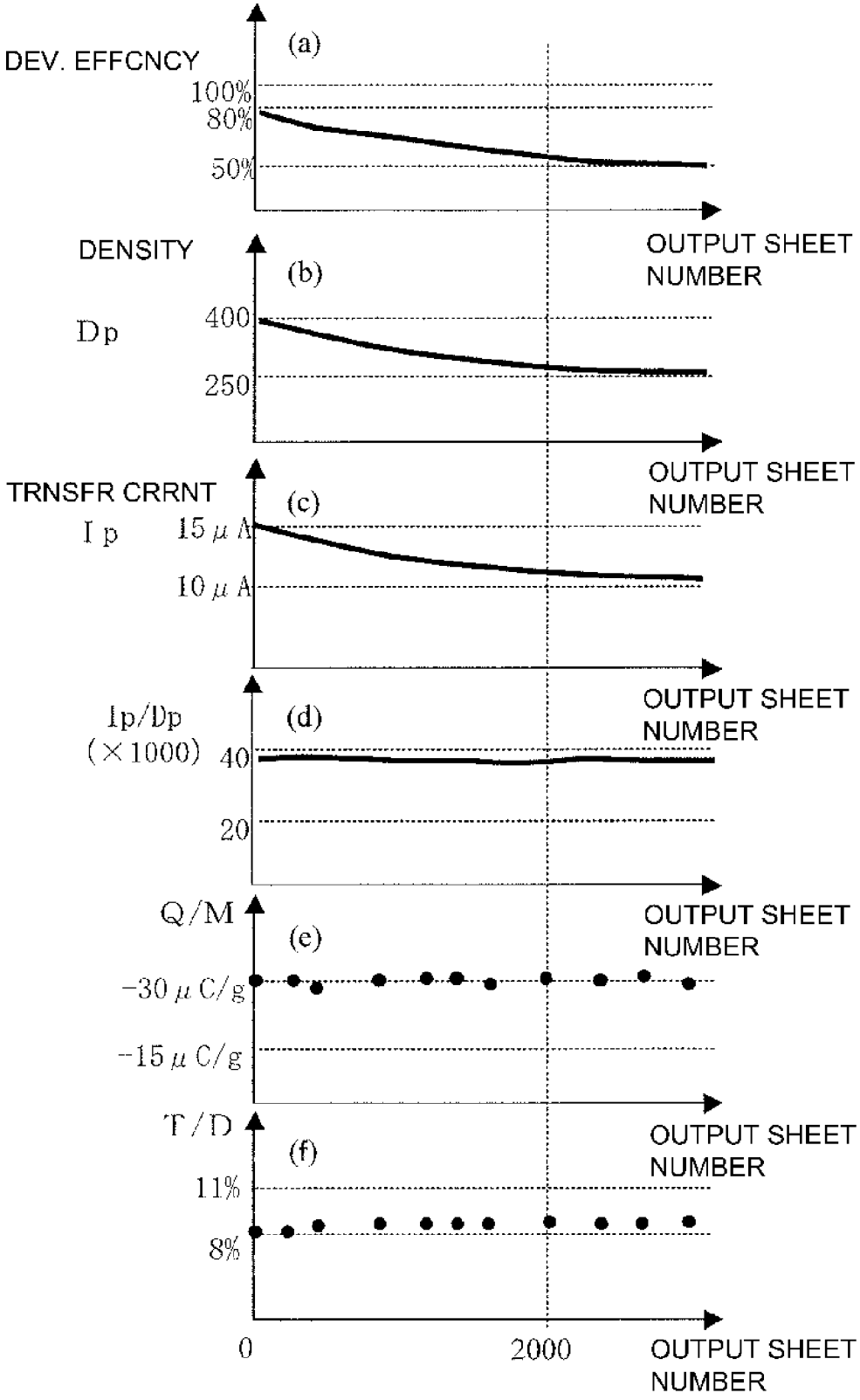

Parts (a) to (f) of FIG. 7 are graphs for illustrating a change in toner charge amount Q/M in control in Embodiment 1.

Figure 8:
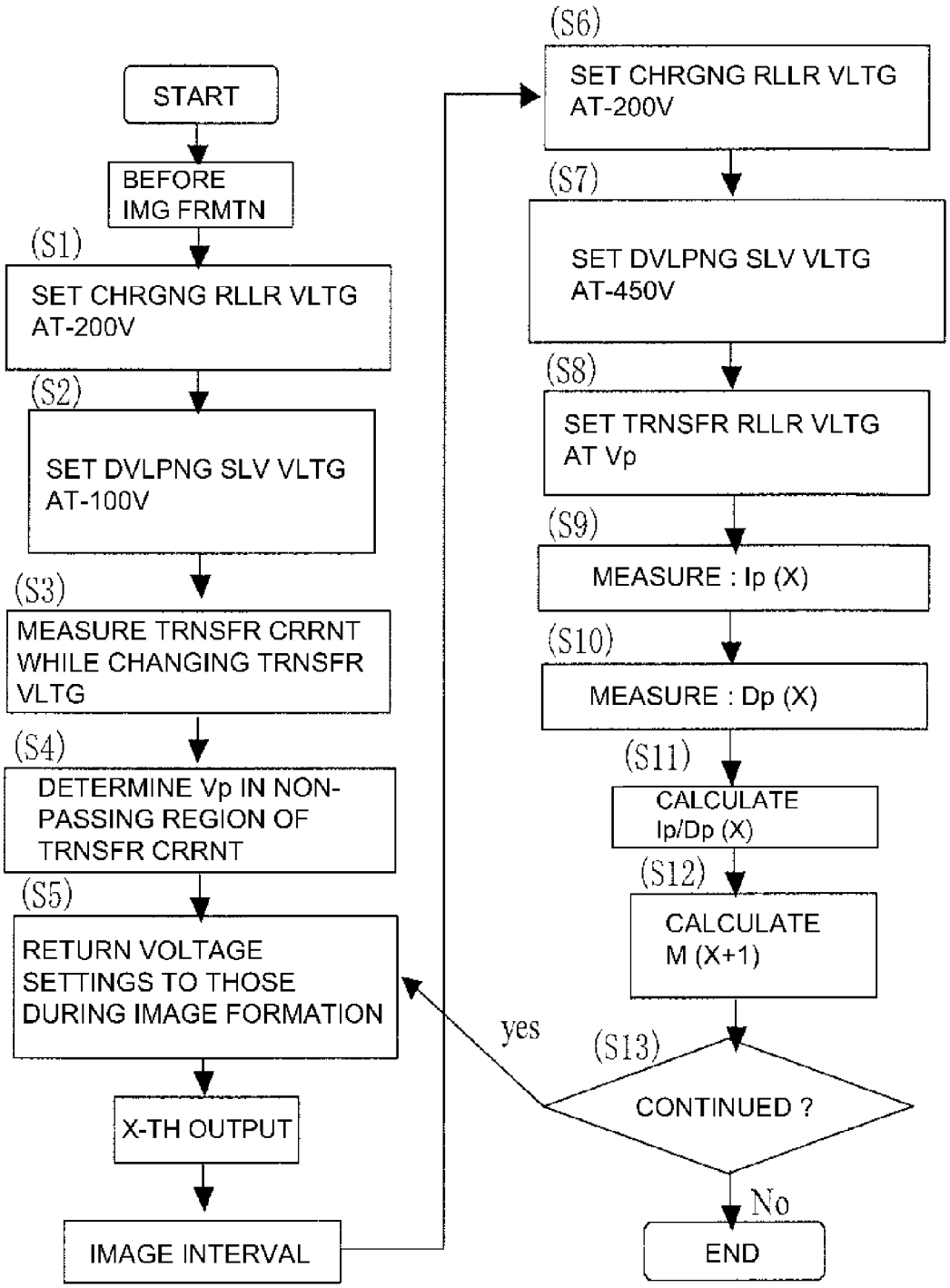

FIG. 8 is a flow chart of control in Embodiment 1.

Figure 9:
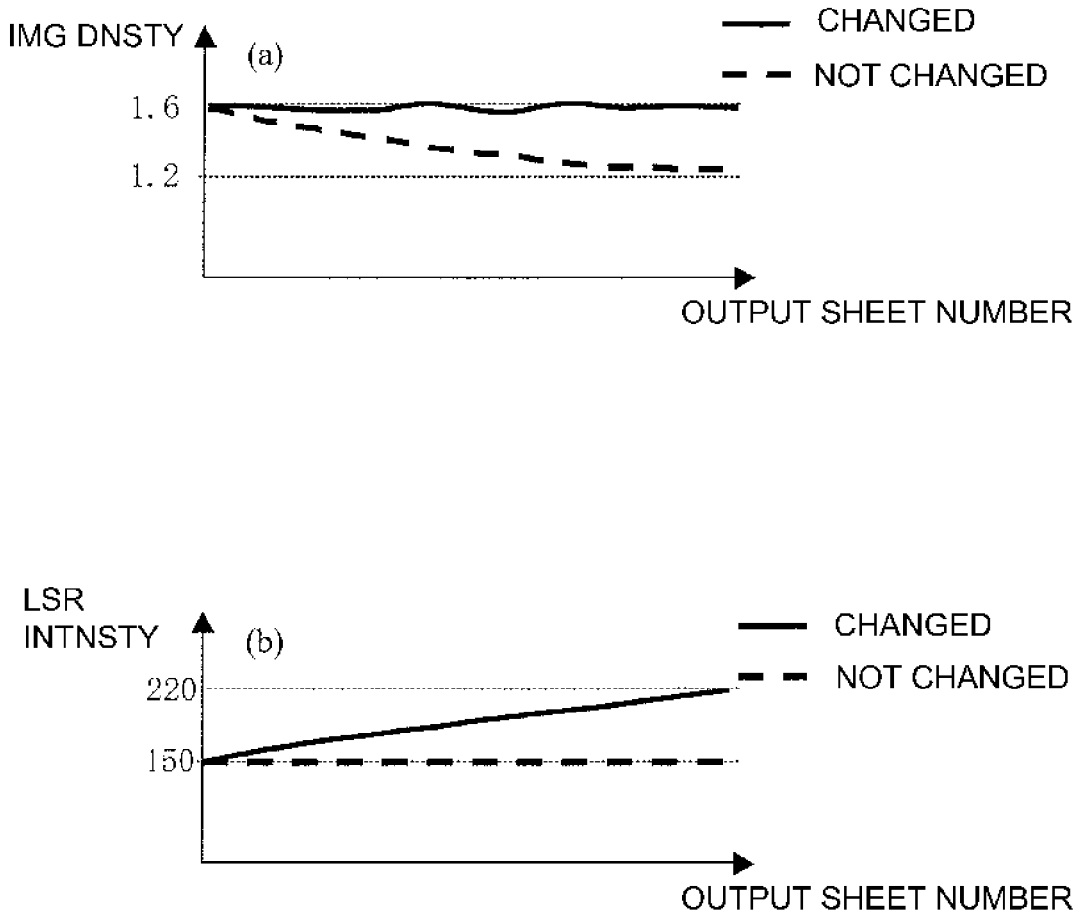

Parts (a) and (b) of FIG. 9 are graphs for illustrating image density control by laser light intensity.

Figure 10:
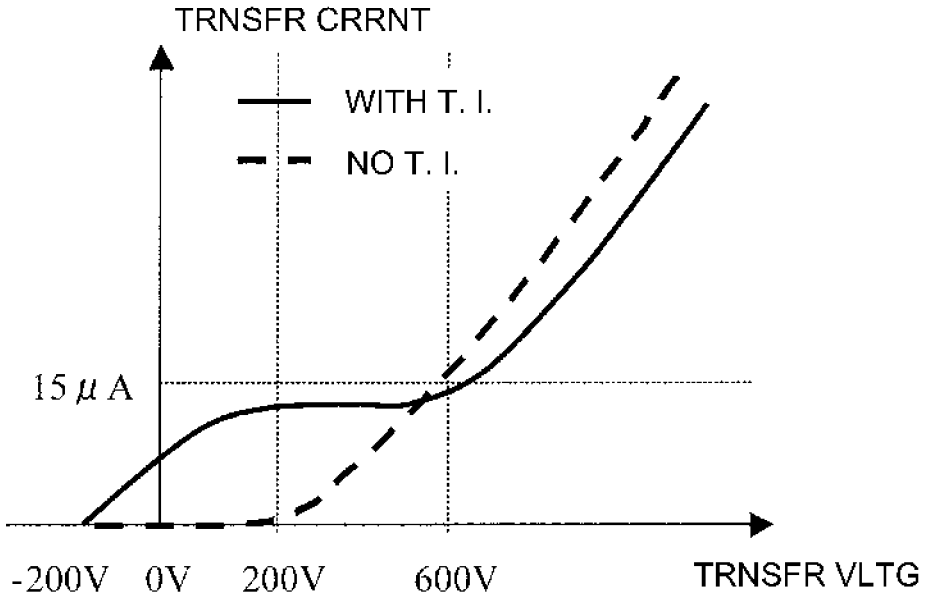

FIG. 10 is a graph showing a relationship between a transfer voltage and a transfer current applied to the transfer roller.

Figure 11:
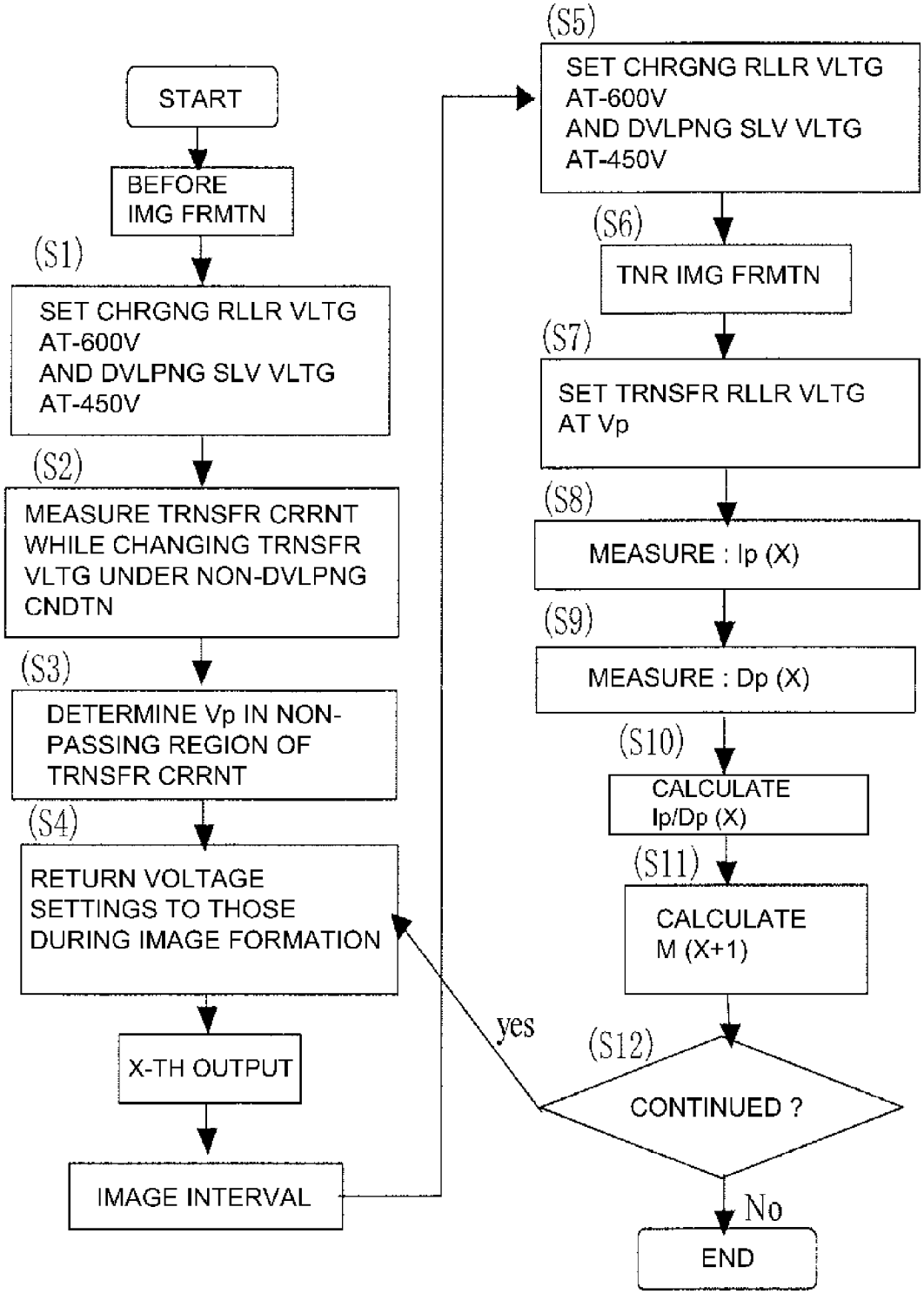

FIG. 11 is a flow chart of control in Embodiment 2.

DESCRIPTION OF THE PREFERRED EMBODIMENTS

Hereinbelow, embodiments of the present invention will be described in detail with reference to the drawings. The present invention can be carried out also in other embodiments in which a part or all of constitutions of the respective embodiments are replaced by their alternative constitutions so long as a toner image transferred with a transfer current lower than that during image formation is detected.

Therefore, the present invention can be carried out not only in lateral stirring type in which a developing chamber and a stirring chamber are horizontally disposed but also in a vertical stirring type developing device in which the developing chamber and the stirring chamber are obliquely or vertically disposed. The present invention can be carried out in not only a developing device using a single developer carrying member but also a developing device using two or three developer carrying members.

When the image forming apparatus uses a two-component developer, the present invention can be carried out irrespective of tandem type/one drum type, intermediary transfer type/recording material conveyance type/direct transfer type, monochromatic/full-color, an electrostatic image forming system, a charging system and an exposure system. In the following embodiments, only a principal portion concerning formation/transfer of the toner image will be described but the present invention can be carried out in image forming apparatuses with various uses including printers, various printing machines, copying machines, facsimile machines, multifunction machines, and so on by adding necessary equipment, options, or casing structures.

<Image Forming Apparatus>

Figure 1:
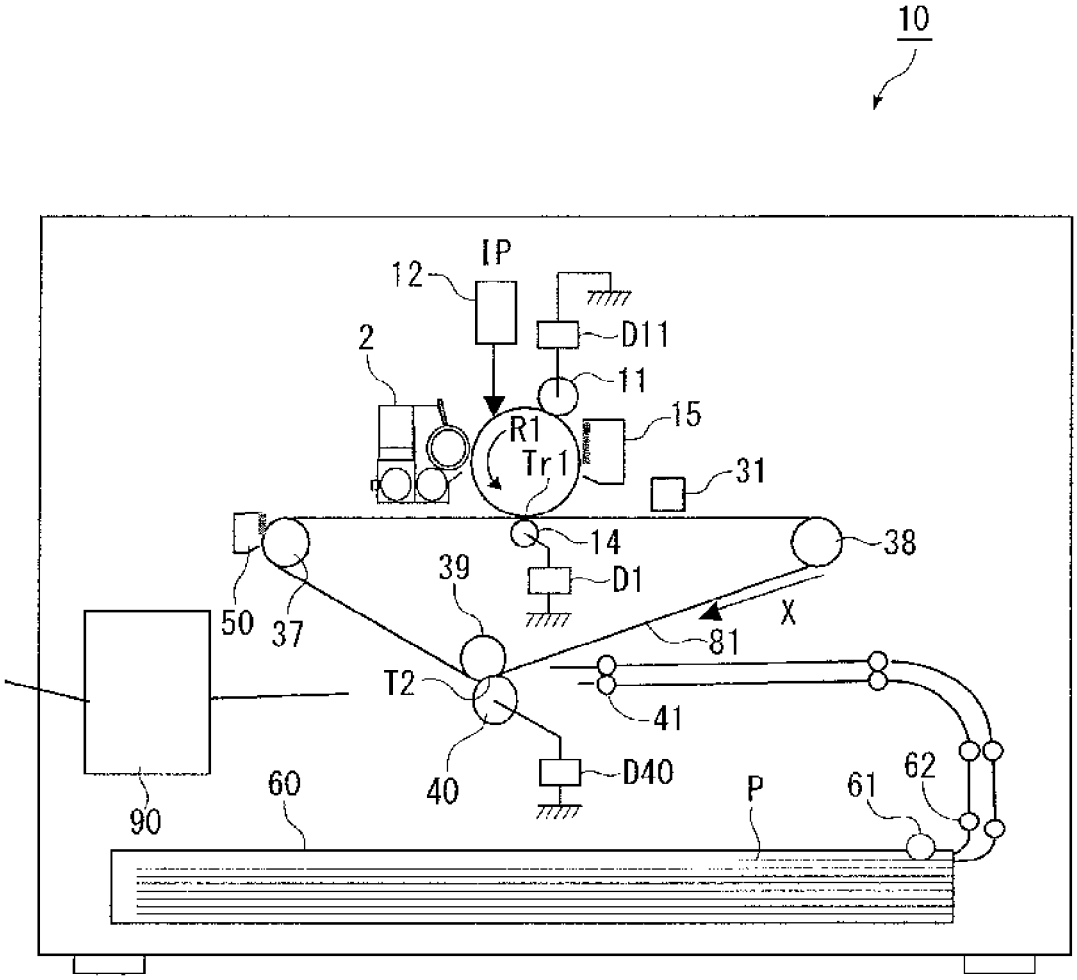
FIG. 1 is an illustration of a structure of an image forming apparatus.

FIG. 1 is an illustration of structure of an image forming apparatus. As shown in FIG. 1, in an image forming apparatus 10, around a photosensitive drum 1, a charging roller 11, an exposure device 12, a developing device 2, a transfer roller 14 and a drum cleaning device 14 are provided.

The photosensitive drum 1 is prepared by forming a photosensitive layer having a negative charge polarity on a substrate of an aluminum cylinder and is rotated in an arrow R1 direction at a process speed of 300 mm/sec. The charging roller 11 electrically charges the surface of the photosensitive drum 1 uniformly to a dark portion potential VD of the negative polarity. The exposure device 12 writes (forms) an electrostatic image for an image on the surface of the photosensitive drum 1. A surface potential of the photosensitive drum 1 charged to the dark portion potential VD is lowered to a light portion potential VL by the light exposure, so that the negatively charged toner can be deposited on the electrostatic latent image.

The developing device 2 reversely develops the electrostatic latent image formed on the photosensitive drum 1 to form a toner image. The transfer roller 14 contacts the photosensitive drum 1 to form a transfer portion Tr1 where the toner image is to be transferred onto an intermediary transfer belt 81. A power source D1 applies a DC voltage of the positive polarity to the transfer roller 14, so that the toner image carried on the photosensitive drum 1 is transferred onto the intermediary transfer belt 81.

The toner image transferred on the intermediary transfer belt 81 is conveyed to a secondary transfer portion T2, where the toner image is secondary-transferred onto a recording material P. A secondary transfer roller 40 contacts the intermediary transfer belt 81 supported by an opposite roller 39 to form the secondary transfer portion T2. The recording material P drawn out from a recording material cassette 60 by a pick-up roller 61 is separated one by one by a separating roller 62 and then is sent to registration rollers 41. The registration rollers 41 receive the recording material P in a rest state to place the recording material P is a stand-by state and then send the recording material P to the secondary transfer portion T2 while timing the recording material P to the toner image on the intermediary transfer belt 81.

In a process in which the superposed intermediary transfer belt 81 and recording material P pass through the secondary transfer portion T2, a power source D2 applies a DC voltage to the secondary transfer roller 40, so that the toner image carried on the intermediary transfer belt 81 is transferred onto the recording material P. The recording material P on which the toner image is transferred is curvature-separated from the intermediary transfer belt 81 and is sent into a fixing device 90, in which the toner image is fixed under application of heat and pressure on the surface of the recording material, and then the recording material P is discharged to the outside of the image forming apparatus. A belt cleaning device 50 collects a transfer residual toner, which is not transferred on the recording material P at the secondary transfer portion T2, by bringing its cleaning blade into contact with the intermediary transfer belt 81.

The intermediary transfer belt 81 is stretched by a driving roller 37, a tension roller 38 and the opposite roller 39 and is driven by the driving roller 37 to be rotated at a rotational speed of 300 mm/sec. As the intermediary transfer belt 81, a seamless belt of electroconductive polyimide having a thickness of 80 μm and a volume resistivity of $1\times10^{10}$ Ω.cm was used.

The drum cleaning device 15 is disposed downstream of the transfer roller 14 with respect to a rotational direction of the photosensitive drum 1. The drum cleaning device 15 removes a transfer residual toner which is not transferred at a transfer portion Tr1 by rubbing the photosensitive drum 1 with a cleaning blade of an urethane rubber.

<Electrostatic Image Forming Portion>

The charging roller 11 and the exposure device 12 which are an example of an electrostatic image forming portion form the electrostatic image on the photosensitive drum 1 which is an example of the image bearing member. The charging roller 11 is constituted in a roller shape as a whole and is press-contacted to the photosensitive drum 1 with a predetermined pressure, thus being rotated by the rotation of the photosensitive drum 1 in contact to the surface of the photosensitive drum 1. The power source D1 applies an oscillating voltage, in the form of a DC voltage biased with an AC voltage, to the charging roller 11 and thus uniformly charges the surface of the photosensitive drum 1 to the dark portion potential of the negative polarity. The DC voltage is changed correspondingly to a target charging potential of the photosensitive drum 1 and is approximately −600 V during image formation. As the AC voltage, a rectangular waveform of 2 kHz in frequency and 1.5 kVpp in peak-to-peak voltage was used.

The exposure device 12 scans the surface of the photosensitive drum 1 through a rotating mirror with a laser beam which is subjected to ON-OFF modulation of scanning line image data developed from the image, thus writing the electrostatic image for the image on the surface of the photosensitive drum 1. The surface potential of the photosensitive drum 1 charged to the dark portion potential VD is lowered to the light portion potential VL by the light exposure, so that the negatively charged toner can be deposited on the electrostatic image. An image signal for an original is projected via a polygon mirror (not shown) or the like onto the photosensitive drum 1 negatively charged by the charging roller 11, so that the electrostatic image is formed. Intensity of the laser beam from the exposure device 12 can be charged in a range from 0 to 225, so that the light portion potential VL of the electrostatic image can be changed.

<Developing Device>

Figure 2:
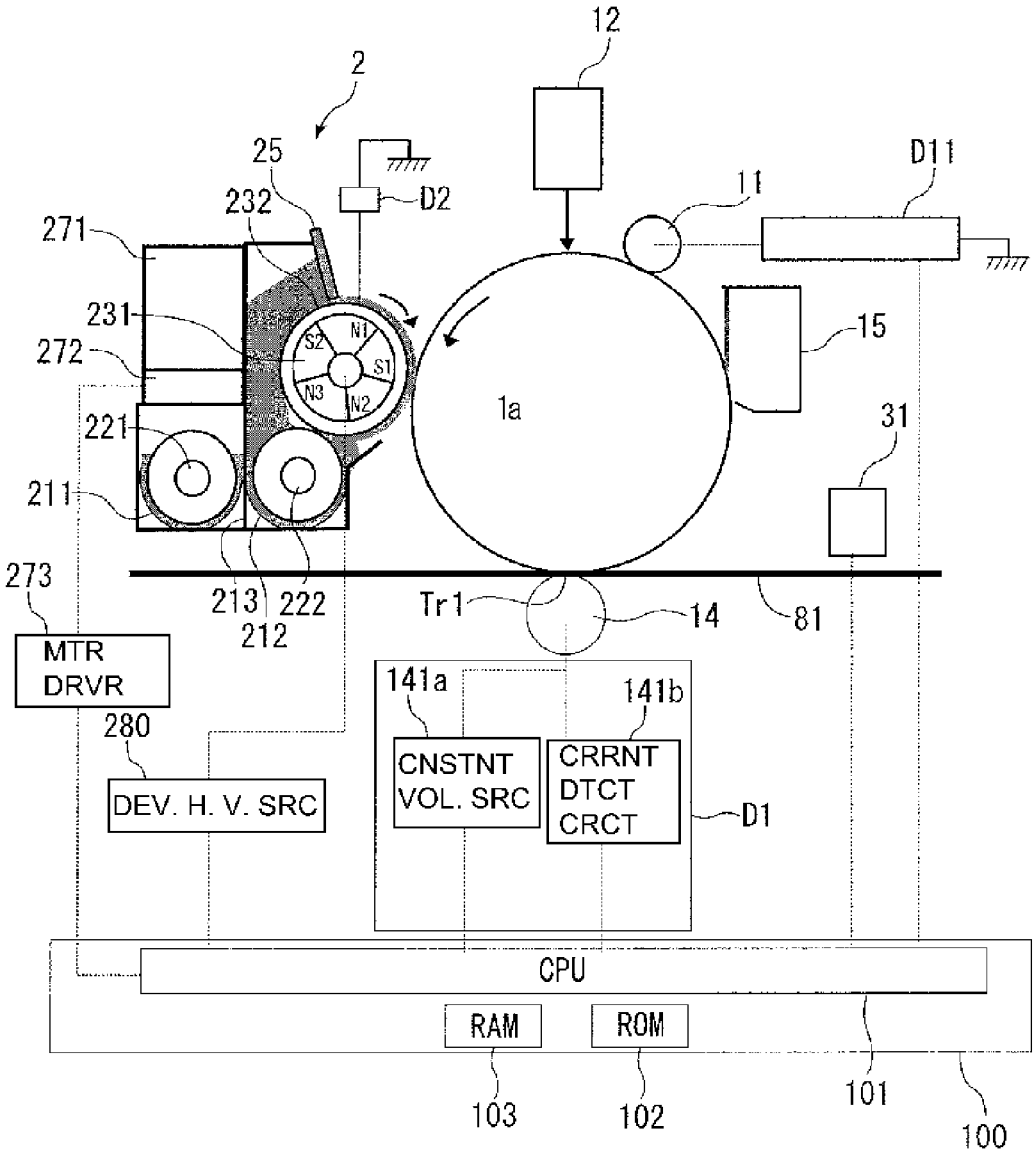
FIG. 2 is an illustration of a structure of a developing device in a cross-section perpendicular to an axis.
Figure 3:
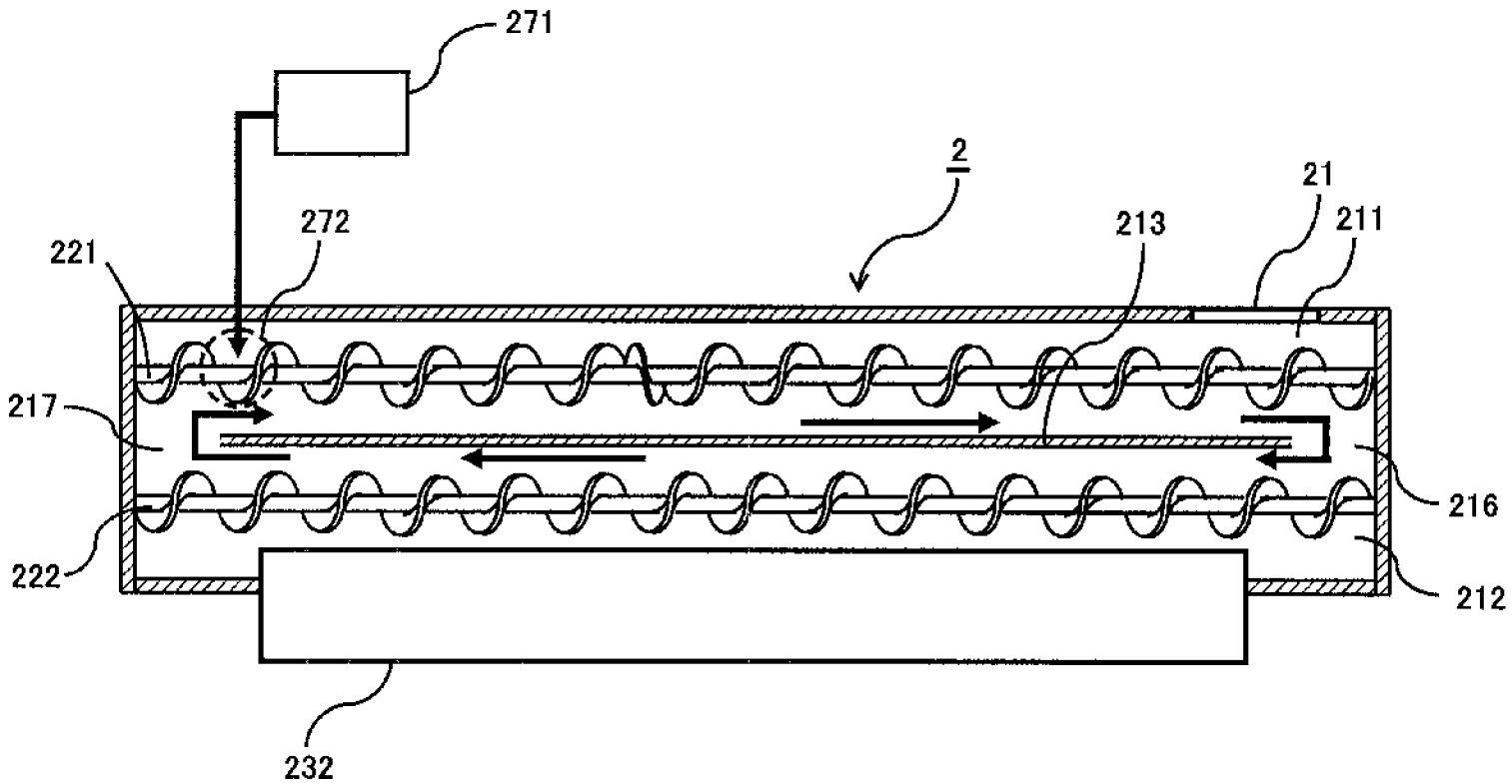
FIG. 3 is an illustration of a structure of the developing device in horizontal cross-section.

FIG. 2 is an illustration of a structure of the developing device in cross-section perpendicular to an axis (shaft). FIG. 3 is an illustration of a structure of the developing device in horizontal cross-section.

As shown in FIG. 2, the developing device 2 develops the electrostatic image, into the toner image, with the developer containing the toner and a carrier. The developing device 2 is of a two-component development type using the two-component developer, and the developer principally contains the toner (non-magnetic) having the negative charge polarity and the carrier (magnetic) having the positive charge polarity. The inside of the developing device 2 is partitioned into a developing chamber 212 and a stirring chamber 211 by a partition wall 213 extending in the vertical direction. In the developing chamber 212, a developing screw 222 is provided. The developing screw 222 stirs and feeds the developer in the developing chamber 212 to supply the developer to a developing sleeve 232. In the stirring chamber, a stirring screw 221 is provided. The stirring screw 221 feeds the developer while stirring and mixing the toner supplied from a toner supply container 271 through a toner supplying portion 272 with the developer in the stirring chamber 211, thus uniformizing a toner content of the developer.

As shown in FIG. 3, the partition wall 213 between the developing chamber 212 and the stirring chamber 211 is provided with developer passages 216 and 217, where the developing chamber 212 and the stirring chamber 211 communicate with each other, at end portions in a front side and a rear side. The developer in the developing chamber 212 in which the toner is consumed and the developer is lowered in toner content, is moved to the stirring chamber 211 through the developer passage 217. The developer in the stirring chamber 211 in which the toner content is restored by being supplied with the toner through the toner supplying portion 272, is moved to the developing chamber 212 through the developer passage 216. In a process in which the developer is fed under stirring between the developing chamber 212 and the stirring chamber 211, the toner and the carrier rub each other to be charged to the negative polarity and the positive polarity, respectively.

As shown in FIG. 2, in the developing chamber 212, the non-magnetic developing sleeve 32 is rotatably disposed. Inside the developing sleeve 232, a magnet 231 is fixedly provided. The magnet 231 may desirably have three or more magnetic poles with respect to a circumferential direction and has fire magnetic poles in this embodiment.

The developer stirred by the developing screw 222 in the developing chamber 212 is constrained by a magnetic force of a scooping pole N2 and is fed by rotation of the developing sleeve 232. The developer is sufficiently constrained by a cutting pole S2 having a magnetic flux density of a certain level or more and is cut by a regulating blade 25 in a state in which a magnetic brush is formed. The regulating blade 25 cuts a magnetic chain of the developer to optimize a layer thickness of the developer carried by the developing sleeve 232.

The developer having the optimized layer thickness is constrained at the surface of the developing sleeve 232 by magnetic flux formed between the cutting pole S2 and a feeding magnetic pole N1 and magnetic flux formed between the feeding magnetic pole N1 and a developing pole S1, and is fed to the developing pole S1 with the rotation of the developing sleeve 232. The developing pole S1, opposing the photosensitive drum 1, for forming a developing region forms and erects the magnetic brush on the surface of the developing sleeve 232, so that the photosensitive drum 1 is rubbed with an end of the chain of the magnetic brush.

The power source D2 applies an oscillating voltage, in the form of a DC voltage Vdc biased with an AC voltage Vac, to the developing sleeve 232, so that the toner electrostatically constrained by the magnetic brush is transferred onto the electrostatic image on the photosensitive drum 1. As a result, the toner with a density which electrically cancels a developing contract Vcont which is a potential difference between the light portion potential VL formed by exposing the photosensitive drum 1 to light and the DC voltage Vdc applied to the developing sleeve 232. The DC voltage applied to the developing sleeve 232 during the image formation is approximately −500 V.

<Supplying Device>

As the developer, there are two develops including a one-component developer principally containing a magnetic toner and the two-component developer principally containing the non-magnetic toner and the magnetic carrier. In the image forming apparatus for forming a full-color or multi-color image, from the viewpoint of a color tint of the image, in most cases, the two-component developer is used. In the two-component developer, when the image formation is effected, the toner is consumed and thus the toner content (T/D ratio) which is a ratio of a weight of the toner to a weight of the developer is lowered. For that reason, there is a need to keep the toner content (T/D ratio) at a constant level by supplying the toner in an amount corresponding to that consumed every image formation is supplied from the toner supplying portion.

As shown in FIG. 2, the toner supplying portion 272 which is an example of the supplying device supplies the toner to the developing device 2.

In the developing device 2, when the toner content (T/D ratio) of the developer is lowered, a carrier friction opportunity of the toner is increased, so that the toner charge amount (per unit area) Q/M is increased. When the toner charge amount Q/M is increased, the number of toner particles deposited on the same electrostatic image is decreased to lower the toner density of the toner image subjected to the development and therefore a density of an output image is lowered and thus image reproducibility is impaired. For that reason, the toner is supplied from the toner supplying portion 272 so as to keep the toner charge amount Q/M in the developing device 2 in a predetermined range.

Above the stirring chamber 211, the toner supply container 271 is disposed via the toner supplying portion 272. The toner supplying portion 272 stores a certain amount of the toner taken out from the toner supply container 271 and supplies and drops the toner into the stirring chamber 211 correspondingly to an angle of rotation of a toner feeding screw (not shown) in the toner supplying container 272. A controller 100 controls the rotation of the toner feeding screw via a supply motor driving circuit 273 to adjust an amount of the toner supplied to the developing device 2. In ROM 102 connected to CPU 101 of the controller 100, control data and the like for the supply motor driving circuit 273 are stored.

<Transfer Device>

As shown in FIG. 2, the transfer roller 14 which is an example of the transfer device transfers the toner image onto the intermediary transfer belt 81 which is an example of a toner image receiving member by using a first transfer voltage higher than a discharge start voltage during the image formation. The transfer roller 14 is disposed downstream of the developing device 2 with respect to the rotational direction of the photosensitive drum 1. The transfer roller 14 is urged by springs at its both end portions to be press-contacted to the intermediary transfer belt 81, so that the transfer portion Tr1 is formed between the photosensitive drum 1 and the intermediary transfer belt 81. The transfer roller 14 is prepared by forming a cylindrical electroconductive sponge layer on an outer peripheral surface of a metal roller shaft of 8 mm in diameter, thus having an outer diameter of 16 mm. The electroconductive sponge layer of the transfer roller 14 is $10^7$ Ω.cm in volume resistivity.

The toner image subjected to the development by the developing device 2 passes through a region of the primary transfer portion Tr1, where the photosensitive drum 1 and the intermediary transfer belt 81 contact, with the rotation of the photosensitive drum 1 and in the process, a power source 141*a* applies a transfer voltage which is a DC voltage as a constant voltage. By the transfer voltage, the toner image is primary-transferred onto the intermediary transfer belt 81. During the image formation, the transfer voltage applied to the transfer roller 14 is approximately +900 V.

A current detecting circuit 141*b* which is an example of a first detecting portion generates an output corresponding to a transfer current when the toner image is transferred onto the intermediary transfer belt 81. The current detecting circuit 141*b* detects the transfer current passing through the transfer roller 14 during the transfer.

<Patch Detecting Sensor>

A patch detecting sensor 31 which is an example of a second detecting portion generates an output corresponding to the toner amount of the toner image transferred on the intermediary transfer belt 81 as the toner image receiving member. The patch detecting sensor 31 is provided downstream of the primary transfer portion Tr1 with respect to the rotational direction of the intermediary transfer belt 81.

The patch detecting sensor 31 is an optical sensor for detecting specular reflection light and vertical reflection light by irradiating the surface of the intermediary transfer belt 81 with infrared light. The patch detecting sensor 31 detects the density of the toner image transferred on the intermediary transfer belt 81 at the primary transfer portion Tr1 by using a detection principle such that an amount of the vertical reflection light is increased with and the specular reflection light is decreased with an increase in toner density on the intermediary transfer belt 81.

<Comparative Embodiment>

Figure 4:
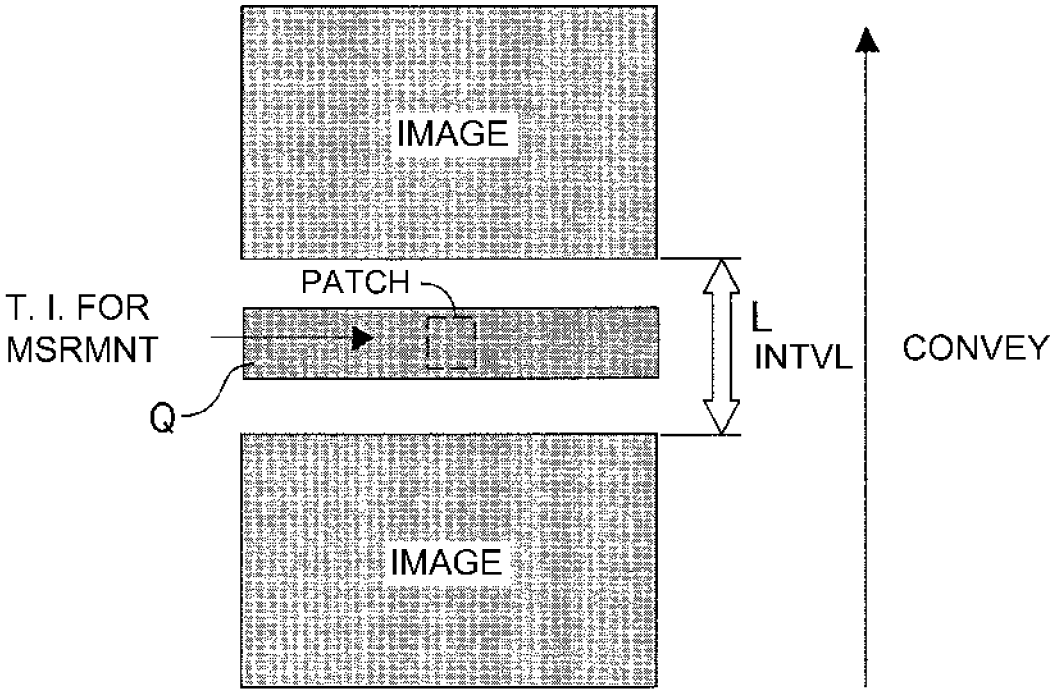
FIG. 4 is an illustration of arrangement of toner images for measurement during continuous image formation.

FIG. 4 is an illustration of arrangement of toner images for measurement during continuous image formation. Parts (a) to (d) of FIG. 5 are graphs for illustrating a change in toner charge amount Q/M in control in Comparative Embodiment. In an operation in an adjusting mode in Comparative Embodiment, a toner-image-for-measurement is formed in conventional patch detection ATR control in the same manner as in Embodiment 1 described later.

Control for keeping the toner content (T/D ratio) at a constant level by providing an inductance sensor in the developing device so as not to change the toner content (T/D ratio) due to accumulation of an error of toner supply for each image formation has been known. However, even at the constant toner content (T/D ratio), the toner charge amount Q/M is largely changed depending on a temperature/humidity and deterioration state of the developer and therefore as a controlling method of the toner supplying portion, the patch detection ATR control has been widely used. In the patch detection ATR control, the toner charge amount Q/M of the developer in the developing device can be kept at a constant level without relying on the inductance sensor, so that a problem of a lowering in image quality or the like can be solved. In the patch detection ATR control a patch toner image of about 3 cm square as an image pattern for image density detection is formed under the same condition as that during image formation and then is transferred onto the intermediary transfer belt under the same condition as that during the image formation. Further, by the optical sensor disposed opposed to the intermediary transfer belt, the toner content of the patch toner image on the intermediary transfer belt is detected and then an amount of the toner supplied from the toner supplying portion is adjusted so that the detected toner content of the patch toner image is a desired value.

However, even in the patch detection ATR control, in the case where an image forming condition of the patch toner image is not stabilized, a proper toner charge amount Q/M of the developer in the developing device cannot be maintained by the influence of the unstable image forming condition. The toner charge amount Q/M fluctuates depending on various factors and therefore it is not easy to keep the toner charge amount Q/M at a constant level.

As shown in FIG. 4 with reference to FIG. 2, in Comparative Embodiment, during the continuous image formation, in a non-image forming region (image interval L) between a trailing end of an image to be outputted and a leading end of a subsequent image to be outputted, a toner-image-for-measurement Q is formed in place of the conventional patch toner image. The toner-image-for-measurement Q corresponds to an image pattern for image density detection as will be described later.

The controller 100 forms an electrostatic image for the toner-image-for-measurement Q in the image interval L on the photosensitive drum 1 always under the same charging/exposure condition. The electrostatic image for the toner-image-for-measurement Q is developed into the toner-image-for-measurement Q by the developing device 2. The toner-image-for-measurement Q is transferred from the photosensitive drum 1 onto the intermediary transfer belt 81 at a position of the transfer roller 14, and then the density of the toner-image-for-measurement Q after the transfer is measured by using the patch detecting sensor 31. Further, the controller 100 contacts the toner supplying portion 272 so that the image density detected by the patch detecting sensor 31 is constant level.

However, in the patch detection ATR control in Comparative Embodiment, in the case where the image forming condition for the toner-image-for-measurement is not stabilized, there is a possibility that the proper toner charge amount Q/M cannot be maintained by the influence of the unstable image forming condition.

The toner density of the toner-image-for-measurement on the intermediary transfer belt 81 is influenced by the following uncertain factors ((1) to (3)) and therefore even when the toner density is accurately measured by the patch detecting sensor 31, there is a possibility that the toner charge amount Q/M cannot be accurately controlled.

(1) Electrostatic image forming step (2) Electrostatic image developing step (3) Toner image transferring step In the case where a characteristic of the step is fluctuated in either of the above steps (1) to (3), even when the toner charge amount Q/M is the same, the toner density of the toner-image-for-measurement is changed, with the result that the image density detected by the patch detecting sensor 31 varies.

As shown in (a) to (d) of FIG. 5, in the case where the developing step is not stabilized, in the control in Comparative Embodiment, the toner charge amount Q/M is lowered. In these figures, the abscissa represents the number of output sheets (A4 size), and the ordinate represents progressions of a developing efficiency in (a) (of FIG. 5), a detection result of the patch detecting sensor in (b), the toner charge amount Q/M of the toner-image-for-measurement on the photosensitive drum in (c), and the toner content (T/D ratio) of the developer in (d). The toner-image-for-measurement Q is an image with an image ratio (a proportion of toner consumption to that at the maximum image density) of 2%.

As shown in (a) of FIG. 5, in the case where the developing efficiency for the toner image is gradually decreased during continuous image formation, the toner supplying portion 272 is controlled so that the image density of the toner-image-for-measurement is kept at a constant level as shown in (b) of FIG. 5. The lowering in developing efficiency for the toner image is generated by a change in temperature/humidity during image formation and a change in characteristic of the photosensitive layer with accumulation of image formation. In Comparative Embodiment, control in the order of lowering in developing efficiency, lowering in image density, increase in toner supply amount, increase in toner content (T/D ratio), decrease in toner charge amount, and increase in image density is effected. As a result, in Comparative Embodiment, in order to remedy the lowering in developing efficiency in (a) of FIG. 5, the toner charge amount Q/M, in (c) of FIG. 5, which should be originally kept at a constant value is lowered.

Here, the developing efficiency is an index defined by the following equation.

(Developing efficiency)={(toner image potential after development)−(light portion potential of electrostatic image)}/{(developing DC potential)−(light portion potential of electrostatic image)}

Therefore, when the toner image potential after the development is equal to the developing DC potential, the developing efficiency is 100%, so that the electrostatic image is completely filled with the toner. However, as shown in (a) of FIG. 5, the developing efficiency of about 80% at an initial stage is gradually lowered with accumulation of the continuous image formation. In this state, in order to maintain the image density, there is no other choice but to lower the toner charge amount Q/M, so that the toner charge amount Q/M is lowered by supplying the toner thereby to increase the toner content (T/D ratio). As a result, the toner charge amount Q/M of about −30 μC/g at the initial stage is lowered to −20 μC/g after the image formation of 2000 sheets.

Similarly, also in the case where the electrostatic image condition is changed in (1) electrostatic image forming step and in the case where the transfer efficiency (a proportion of the transferred toner) is changed in (3) toner image transferring step, the toner charge amount Q/M is changed. For that reason, in Comparative Embodiment (conventional patch detection ATR control), the toner content (T/D ratio) is increased or decreased so as to keep the toner image density at a constant level, so that the important toner charge amount Q/M is deviated from a proper range.

When the toner charge amount Q/M is out of the proper range, image quality deterioration and toner scattering are liable to occur. The image quantity deterioration refers to white dropout or the like due to a lowering in graininess (grainy texture)/white background fog/improper transfer. When the toner charge amount Q/M is increased and is out of the proper range, the lowering in image density and the image quality deterioration (white dropout due to improper transfer) are liable to occur. Even when control for keeping the toner content (T/D ratio) at a constant level by providing an inductance sensor in the developing device is effected, the toner charge amount Q/M varies depending on the various factors and therefore it is not easy to keep the toner charge amount at a constant level. There also arises a problem of additional cost and space for providing the inductance sensor.

Therefore, in the following embodiments, a constitution capable of keeping the toner charge amount Q/M of the developer in the developing device at the constant level without relying on the inductance sensor is employed, so that the problem of the image quality lowering or the like can be solved. In the following embodiments, even when the characteristics in (1) electrostatic image forming step, (2) electrostatic image developing step, and (3) toner image transferring step are changed.

<Embodiment 1>

Parts (a) and (b) of FIG. 6 are graphs for illustrating a relationship between a transfer voltage and a transfer current applied to the transfer roller and a relationship between the transfer voltage and a transfer efficiency. Parts (a) to (f) of FIG. 7 are graphs for illustrating a change in toner charge amount Q/M in control in Embodiment 1.

As shown in FIG. 2, the controller 100 which is an example of a control means forms the toner-image-for-measurement Q on the photosensitive drum 1 during non-image formation and then transfers the toner-image-for-measurement Q from the photosensitive drum 1 onto the intermediary transfer belt 81 by using a second transfer voltage lower than a discharge start voltage. The controller 100 contacts a charging potential to form the electrostatic image under a predetermined condition without using the exposure device 12, thus forming the toner-image-for-measurement in a band-like shape corresponding to a development width of the developing device 2.

As shown in FIG. 4, in Embodiment 1, during the continuous image formation, the toner-image-for-measurement Q is formed, by an analog system for effecting image formation without using the laser light, in a non-image forming region (image interval L) between a trailing end of an output image and a leading end of a subsequent output image. A band-like electrostatic image is formed by lowering, without effecting the exposure, the DC voltage applied to the charging roller 11 from about −600 V to −200 V with timing of the toner-image-for-measurement Q. The AC voltage applied to the charging roller 11 is 1.5 kVpp which is the same as that during normal image formation.

As a result, the band-like toner image is formed over a full development width of the developing device 2 and therefore at the transfer portion Tr1, a transfer current through the toner-image-for-measurement Q is generated in the substantially entire are of the photosensitive drum 1 with respect to a longitudinal direction. An error factor which generates the transfer current by direct control between the transfer roller 14 and the intermediary transfer belt 81 is reduced.

As shown in FIG. 2, in Embodiment 1, a value Ip of the transfer current passing through the transfer roller 14 when the toner-image-for-measurement Q is transferred onto the intermediary transfer belt 81 is detected by the current detecting circuit 141*b*. Further, a density Dp of the toner-image-for-measurement transferred on the intermediary transfer belt 81 is detected by the patch detecting sensor 31.

In (a) of FIG. 6, the ordinate represents the transfer current value Ip obtained by subtracting a value of a current (transfer voltage proportional component) passing through a resistance component of the transfer portion Tr1 from an actually measured value of the transfer current detected by the transfer current detecting circuit 141*b*. In (a) of FIG. 6, a solid line represents a transfer voltage-transfer current characteristic in the case where the toner image is formed, under application of the DC voltage of −450 V to the developing sleeve 232, in an amount corresponding to the developing contrast of 250 V (=(−200 V)−(−450 V)). Further, a broken line represents a transfer voltage-transfer current characteristic in the case where the toner image is not formed, under application of the DC voltage of −100 V to the developing sleeve 232, at the developing contrast of −100 V (=(−200 V)−(−100 V)).

As shown in (a) of FIG. 6, the value Ip of the transfer current passing through the transfer roller 14, depending on the DC voltage (transfer voltage) applied to the transfer roller 14, by a factor other than the resistance component of the transfer portion Tr1 assumes different behavior before and after electric discharge.

(1) In the case where the toner image is transferred (solid line), the transfer current is largely increased from −200 V to (+)200 V and then is gradually increased until the neighborhood of 600 V. In response to an electric field generated between the photosensitive drum 1 and the intermediary transfer belt 81, toner particles with a large charge amount are first transferred and then toner particles with a small charge amount are transferred. In the case where the toner image is not transferred (broken line), the transfer current is not carried and therefore the transfer current passing through the transfer roller 14 in this voltage range is the transfer current with charge transfer by the transfer of the toner, so that a resultant transfer current value depends on a total charge amount Q of the transferred toner.

(2) At 600 V or more, in both of the case where the toner image is transferred (solid line) and in the case where the toner image is not transferred (broken line), the transfer current value Ip tends to increase. This is attributable to a result of addition of a discharge current, directly flowing between the photosensitive drum 1 and the intermediary transfer belt 81, generated by an occurrence of the electric discharge between opposing surfaces at the transfer portion Tr1.

Therefore, when the transfer voltage applied to the transfer roller 14 is in a non-electric discharge range (less than 600 V), a value Ip/Dp which is a ratio of the transfer current value Ip to the toner-image-for-measurement density Dp detected by the patch detecting sensor 31 is proportional to the toner charge amount Q/M. This is because the transfer current value Ip is proportional to the charge amount Q of the toner.

For this reason, in Embodiment 1, the transfer voltage applied to the transfer roller 14 is set at a voltage in the non-discharge range (less than 600 V) and then the toner supply control is effected so that the value (ratio) Ip/Dp is constant, so that the toner charge amount Q/M of the toner in the developing device is kept at a constant value. In the control in this embodiment, the transfer of the toner-image-for-measurement is performed at a second transfer voltage lower than a discharge start voltage of 600 V and therefore a transfer efficiency of the toner-image-for-measurement at the transfer portion Tr1 is lowered. However, a numerical value obtained by dividing "the transfer current value of the basis of an output of the current detecting circuit 141*b*" by "the toner amount on the basis of an output of the patch detecting sensor 31" corresponds to the toner charge amount Q/M with high accuracy.

On the other hand, in the case where the transfer of the toner-image-for-measurement is performed at a first transfer voltage higher than the discharge start voltage, the transfer efficiency of the toner-image-for-measurement at the transfer portion Tr1 is largely increased comparably to that during the image formation. However, the transferred toner particles are influenced by the electric discharge and thus the charge amount thereof is changed. For this reason, the numerical value obtained by dividing "the transfer current value on the basis of an output of the current detecting circuit 141*b*" by "the toner amount on the basis of an output of the patch detecting sensor 31" is a value irrespective of the toner charge amount Q/M. Therefore, the transfer voltage in the discharge range (exceeding 600 V) cannot be used in this embodiment as the transfer voltage applied to the transfer roller 14.

Also in the control in this embodiment, as described above, the characteristics in (1) electrostatic image forming step, (2) electrostatic image developing step and (3) toner image transferring step can be changed. However, even when the toner-image-for-measurement density DP is changed, at the same time, the transfer current value Ip is also changed and therefore the toner charge amount Q/M can be controlled at a constant value by keeping the value Ip/Dp at a constant value, As shown in (e) of FIG. 7, in continuous image formation of 3000 sheets, the image with the image ratio (the proportion of the toner consumption to the maximum image density) of 2% was outputted and the toner supply control was effected so that the value Ip/Dp was constant. In (a) to (f) of FIG. 7, the abscissa represents the number of output sheets. Further, the ordinate represents progressions of the developing efficiency of the toner-image-for-measurement Q in (a), a detection result Dp of the patch detecting sensor 31 in (b), the detected current value Ip of the toner-image-for-measurement Q during the transfer in (c), a calculation result of Ip/Dp in (d), the toner charge amount Q/M of the toner image on the photosensitive drum 1 in (e), and the toner content (T/D ratio) of the developer in (f). The value Ip/Dp is, for convenience of the calculation, obtained by Ip by 1000 and then by dividing the resultant Ip by Dp.

As shown in (a) of FIG. 7, the developing efficiency, for the toner-image-for-measurement Q, of about 80% of an initial stage was lowered with an increasing number of output sheets. Corresponding to this, as shown in (b) of FIG. 7, also the density Dp of the toner-image-for-measurement Q was lowered. In this case, the amount of the transferred toner is decreased and therefore, as shown in (c) of FIG. 7, the detected current value Ip of the toner-image-for-measurement Q during the transfer was also lowered. Therefore, as shown in (d) of FIG. 7, the calculated value Ip/Dp is not changed. Further, as shown in (d) of FIG. 7, the toner was supplied so that the value Ip/Dp was not changed, so that it became possible to realize stable progression of the toner charge amount Q/M as shown in (e) of FIG. 7.

In the control in this embodiment, the value Ip/Dp is constant and therefore, as shown in (f) of FIG. 7, the toner content (T/D ratio) is prevented from being excessively changed, with the result that a problem resulting from the change in toner charge amount Q/M can be solved as shown in (e) of FIG. 7.

<Toner Charge Amount Control>

FIG. 8 is a flow chart of the control in Embodiment 1. In this embodiment, in advance to the formation of the toner-image-for-measurement Q, an operation in a setting mode in which the discharge start voltage is obtained in a state in which the toner image is not formed on the photosensitive drum 1 and then the second transfer voltage is set can be executed. Before the image formation, a transfer voltage Vp used when the toner-image-for-measurement Q is transferred at the image interval is determined. The discharge start voltage is a transfer voltage at an inflection point where the transfer current passing through the toner image transfer portion diverges from a proportional relationship with respect to the transfer voltage and starts to largely increase when the transfer voltage is changed to increase.

As shown in FIG. 8 with reference to FIG. 2, first, the controller 100 sets the DV voltage to be applied to the charging roller 11 at −200 V, thus charging the surface of the photosensitive drum 1 to −200 V (S1), and then sets the DC voltage to be applied to the developing sleeve 232 at −100 V (S2). In this state, the developing contrast (=(−200 V)−(−100 V)) is the negative value and therefore the negatively charged toner is not transferred onto the photosensitive drum 1, so that the toner-image-for-measurement Q Is not formed.

The controller 100 stepwisely changes the transfer voltage to be applied to the transfer roller 14 to measure a transfer current at each transfer voltage by the current detecting circuit 141*b*, so that a voltage-current characteristic indicated by the broken line in (a) of FIG. 6 is obtained (S3).

The controller 100 obtains, from the relationship indicated by the broken line in (a) of FIG. 6, the discharge start voltage (−600 V) at which the transfer current starts to flow by the electric discharge, and then regards a range of a voltage lower than the discharge start voltage (−600 V) as an undischarge range and determines the transfer voltage Vp to be applied to the transfer roller 14 (S4).

In this embodiment, an error range was set at ±0.3 μA and a range in which a transfer current value VIp was within ±0.3 μA was defined as the undischarge range, and a voltage of 400 V which was lower than the discharge start voltage (600 V) by 200 V was set at the transfer voltage Vp to be applied to the transfer roller 14.

The controller returns the voltage settings of the charging roller 11 and the developing sleeve 232 to those in a condition during the image formation (S5). During the image formation in this embodiment, the DC voltage for the charging roller 11 is −600 V, the DC voltage for the developing sleeve 232 is −500 V, and the DC voltage for the primary transfer roller 14 is 900 V.

Under this condition, image output (X-th sheet) is performed and at an image interval between the X-th sheet and an (x+1)-th sheet, the toner-image-for-measurement Q is formed, thus measuring a value Ip/Dp(X).

The controller 100 sets, at a position corresponding to the image interval, the DC voltage for the charging roller 11 at −200 V (S6) and the DC voltage for the developing sleeve 232 at −450 V (S7). In this state, the developing contrast (=(−200 V)−(−450 V)) is the positive value and therefore the negative charged toner is transferred onto the photosensitive drum 1, so that the toner-image-for-measurement Q is formed.

The controller 100 transfers the toner-image-for-measurement Q onto the intermediary transfer belt 81 by applying the transfer voltage Vp, lower than the discharge start voltage, to the transfer roller 14 (S8), and measures a transfer current Ip(X) by the current detecting circuit 141*b* (S9). Then, by the patch detecting sensor 31, a density Dp(X) of the toner-image-for-measurement on the intermediary transfer belt 81 is measured (S10). The controller 100 obtains the values Ip(X) and Dp(X) and calculates a value IP(X)/Dp(X) (S11).

In ROM 102 of the controller 100, a relationship between the value Ip(X)/Dp(X) and the toner charge amount Q/M of the toner in the developing device 2 is recorded in advance. The controller 100 evaluates, on the basis of the value Ip(X)/Dp(X), the toner charge amount Q/M of the toner in the developing device 2 and then calculates a toner supply amount M(X+1) (S12).

Thereafter, the controller 100 discriminates whether or not a successive image output is performed (S13) and in the case where the image formation is continued (Yes of S13), during image formation of the (x+1)-th sheet, the toner in an associated amount is supplied (S5). In the case where the image formation is ended (No of S13), the image forming apparatus 10 is stopped.

<Toner Supply Control>

As shown in FIG. 2, the controller 100 controls, on the basis of detection results of the current detecting circuit 141*b* and the patch detecting sensor 31, a supplying operation of the toner supplying portion 272 so that a transfer current amount per unit amount of the transferred toner falls within a predetermined range. The controller 100 increases the toner supply amount, by the toner supplying portion 272, with an increase in transfer current amount per unit amount of the transferred toner.

The value Ip/Dp of the toner-image-for-measurement Q formed with an initial developer is Ip/Dp(init)=38. In this embodiment, when Ip/Dp(init) was 38, the toner charge amount Q/M on the photosensitive drum 1 was about −30 μC/g.

Further, the value Ip/Dp of the toner-image-for-measurement Q measured when the X-th sheet is outputted by the image forming apparatus 10 is Ip/Dp(X) =45. In this embodiment, when Ip/Dp(X) was 45, the toner charge amount Q/M on the photosensitive drum 1 was about −35.5 μC/g.

In this case, the toner charge amount Q/M of the toner-image-for-measurement Q is higher than that the initial stage and therefore there is a need to lower the toner charge amount Q/M by supplying the toner with respect to (X+1)-th sheet.

The toner supply amount M(X+1) for the (X+1)-th sheet is determined by the following equation (1) by using Ip/Dp (init), Ip/Dp(X) and a supply coefficient M(reference) recorded in ROM 101 in advance.

$$M(X+1)=(Ip/Dp(\text{init})-Ip/Dp(X))\times M(\text{reference}) \quad (1)$$

Based on the equation (1), in the case of M(X+1)>0, the toner supply is not carried out. From the equation (1), M(X+1) was calculated and was used as the toner supply amount for the (X+1)-th sheet.

<Image Density Control>

Parts (a) and (b) of FIG. 9 are graphs for illustrating image density control by laser light intensity. As shown in (e) of FIG. 7, according to the control in this embodiment, the toner charge amount Q/M can be directly detected and therefore the toner supply control can be effected so that the toner charge amount Q/M is constant. However, in the case where the control is effected so that the toner charge amount Q/M is constant, when the developing efficiency is lowered as shown in (a) of FIG. 7, the important image density is lowered as shown in (b) of FIG. 7.

Therefore, in Embodiment 1, the exposure device 12 is adjusted so that a patch toner image is formed under a predetermined condition and transferred onto the intermediary transfer belt 81 by using the first transfer voltage to be detected by the patch detecting sensor 31 and then on the basis of its detection result, the toner content of the patch toner image can be kept at a constant level.

In an image interval where the toner-image-for-measurement Q is not formed, the patch toner image for adjusting the image density is formed under a normal image forming condition and then is transferred onto the intermediary transfer belt 81 under a normal transfer condition. Then, the patch toner image on the intermediary transfer belt 81 is detected by the patch detecting sensor 31 and depending on the density of the detected patch toner image, the laser light intensity of the exposure device 12 is adjusted to stabilize the image density.

With respect to timing when the patch toner image for image density adjustment, the patch toner image may desirably be formed when the value Ip/Dp converges to the value Ip/Dp(init) by the toner charge amount control using the toner-image-for-measurement Q. For that reason, in this embodiment, in an image interval immediately after the value Ip/Dp for the toner-image-for-measurement Q falls within Ip/Dp(init)±1, the patch toner image for image density adjustment is formed.

Further, when the patch toner image for image density adjustment is formed, the charging and exposure during the normal image formation are carried out. Transfer with a high transfer efficiency is performed by using the transfer voltage higher than the discharge start voltage and then the patch toner image on the intermediary transfer belt 81 is detected by the patch detecting sensor 31. In the case where the density of the patch toner image is low, the laser light intensity is increased and thus the developing contrast is increased. In the case where the density of the patch toner image is high, the lasers light intensity is decreased and thus the developing contrast is decreased.

In the toner charge amount control described with reference to FIG. 7, the laser light intensity was adjusted depending on the density value of the patch toner image. As indicated by a solid line in (b) of FIG. 9, in the case where laser light intensity changing control is executed depending on the density value of the patch toner image for image density adjustment, as indicated by the solid line in (a) of FIG. 9, a reflection density corresponding to a maximum density gradation level (225/225) could be kept at 1.6. In this case, the image density was stabilized by increasing the laser light intensity when the laser light intensity was required to be changed due to the lowering in developing efficiency shown in (a) of FIG. 7. The electrostatic image became deep to increase the developing contrast, so that the image density could be improved and stabilized.

As indicated by a broken line in (b) of FIG. 9, in the case where laser light intensity changing control is not executed depending on the density value of the patch toner image for image density adjustment, as indicated by the broken line in (a) of FIG. 9, a reflection density corresponding to a maximum density gradation level (225/225) was lowered to 1.2. In this case, the laser light intensity was constant, the image density was lowered due to the lowering in developing efficiency shown in (a) of FIG. 7.

In this embodiment, by effects of the toner charge amount Q/M control shown in FIG. 7 and the laser light intensity control shown in FIG. 9, the density of the output image was able to be stabilized while effecting the toner supply control so as to keep Ip/Dp at the constant level.

Incidentally, the method in which the electrostatic image was changed by changing the laser light intensity and thus the image density was stabilized was used, but the electrostatic image may also be changed by a method in which the voltage applied to the charging roller 11 or the developing sleeve 232 is changed. By changing the voltage applied to the charging roller 11 or the developing sleeve 232, similar adjustment can be performed.

Further, in this embodiment, on the basis of the detection result of the density of the patch toner image, the laser light intensity is controlled but the laser light intensity control may also be effected by estimating a state of the developer to estimate the lowering in developing efficiency. Without relying on the patch toner image, the control may also be replaced with control in which the laser light intensity is increased depending on the number of output sheets.

Further, in the case where the electrostatic image is adjusted on the basis of the detection result of the density of the patch toner image, the timing when the patch toner image for image density adjustment may also be another timing.

Further, a developing device such that a developer for supply prepared by mixing the carrier with the toner in a predetermined mixing ratio is supplied therein and an excessive developer overflows with the toner supply has been widely used. In this case, there is a problem that the toner chargeability is lowered when the image formation with a low image ratio and with less toner consumption is continued. For that reason, it is desirable that the controller 100 increases a length of the band-like toner-image-for-measurement with respect to the rotation direction with a smaller toner consumption amount per image sheet in the executed continuous image formation.

<Embodiment 2>

In Embodiment 1, the toner-image-for-measurement Q was formed by changing the DC voltage applied to the charging roller 11 in the analog manner. On the other hand, in Embodiment 2, the toner-image-for-measurement Q is formed by a method in which the surface potential of the photosensitive drum 1 charged to the dark portion potential VD is lowered in a digital manner by using the exposure device 12 to form the electrostatic image. In Embodiment 2, with respect to the transfer, the detection, the calculation of Ip/Dp, the toner supply control and the like other than the process for forming the electrostatic image for the toner-image-for-measurement Q are the same as those in Embodiment 1 and therefore will be omitted from redundant description.

In this embodiment, as shown in FIG. 2, the DC voltage of the oscillating voltage applied to the charging roller 11 is set at −600 V to charge the surface of the photosensitive drum 1 to the dark portion potential VD (−600 V). Here, when the exposure device 12 is actuated at the laser alight intensity L=150 to form the electrostatic image, it is assumed that the dark portion potential VD (−600 V) is lowered to the light portion potential VL (−200 V). It is also assumed that the DC voltage Vdc of the oscillating voltage applied to the developing sleeve 232 is set at −450 V to provide the developing contrast, between the light portion potential VL and the DC voltage Vdc, of (−200 V)−(−450 V).

In this embodiment, before image formation, the transfer voltage Vp used when the toner-image-for-measurement Q formed in the image interval is transferred is determined. In this embodiment, the toner-image-for-measurement Q is formed by the digital system in which the electrostatic image for the toner-image-for-measurement Q is formed by using the laser light.

In the case where the electrostatic image for the toner-image-for-measurement Q is formed by using the exposure device 12, the surface potential of the photosensitive drum 1 is different between a region where the electrostatic image is developed and a region where the electrostatic image is not developed, and therefore as shown in FIG. 10, the discharge start voltage at the transfer portion Tr1 becomes lower than that in Embodiment 1. For this reason, a settable range of the transfer voltage applied to the transfer roller 14 when the toner-image-for-measurement is transferred becomes narrower than that in Embodiment 1.

As indicated by the solid line in FIG. 10, in the case where the exposure device 12 forms the electrostatic image with the light portion potential VL=−200 V under the above-described exposure condition and then the developing device 2 develops the electrostatic image into the toner-image-for-measurement Q under the above-described developing condition, a transfer voltage-transfer current characteristic is the substantially same as that in Embodiment 1 shown in FIG. 6. The reason why a current amount by the transfer of the toner image is lower than that in Embodiment 1 shown in FIG. 6 is that an exposure range of the exposure device 12 is narrower than a charged range of the photosensitive drum 1 by the charging roller 11 and the length of the band-like toner image with respect to the widthwise direction of the belt is decreased.

However, as indicated by the broken line in FIG. 10, in the case where the exposure device 12 forms the electrostatic image with the light portion potential VL=−200 V under the above-described exposure condition and the developing device 2 does not develop the electrostatic image into the toner-image-for-measurement Q, the discharge start voltage becomes lower than that in Embodiment 1 shown in FIG. 6. A difference between the analog manner shown in FIG. 6 and the digital manner shown in FIG. 10 is the discharge start voltage in the transfer voltage-transfer current characteristic in the case, indicated by the broken line, where the electrostatic image is not developed.

In the case of the digital manner shown in FIG. 10, on the surface of the photosensitive drum 1 opposing the transfer roller 14 via the intermediary transfer belt 81, the exposure range of the exposure device 12 is a range with the light portion potential VL of −200 V but outside the exposure range, the surface is the dark portion potential VD of −600 V. For this reason, the electric discharge starts at the position opposing the range with the dark portion potential VD at the voltage lower by 400 V than that at the position opposing the range with the light portion potential VL. The surface potential difference of the photosensitive drum 1 between with exposure and without exposure is 400 V and correspondingly the discharge start voltage is shifted to a low voltage side by 400 V.

For that reason, in the digital manner shown in FIG. 10, the discharge start voltage in the region where the electrostatic image is not developed is low and therefore the transfer voltage Vp used during the transfer of the toner-image-for-measurement Q is required to use a range in which no current is carried in the characteristic indicated by the broken line in FIG. 10. However, when the transfer voltage Vp used during the transfer of the toner-image-for-measurement Q is set at a value lower than the discharge start voltage, also in the digital manner, it is possible to effect control for stably maintaining the toner charge amount Q/M by effecting the toner supply control so as to keep the value Ip/Dp at a constant level.

As shown in FIG. 10 with reference to FIG. 2, first, the controller 100 sets the DV voltage to be applied to the charging roller 11 at −600 V, and then sets the DC voltage to be applied to the developing sleeve 232 at −450 V (S1).

Then, in a state in which the toner image is not formed on the photosensitive drum 1, the controller 100, while changing the transfer voltage to be applied to the transfer roller 14, measures a transfer current by the current detecting circuit 141*b*, so that a transfer voltage-transfer current characteristic indicated by the broken line in FIG. 10 is obtained (S2).

The controller 100 determines, on the basis of the obtained transfer voltage-transfer current characteristic, an undischarge range in which the current by the electric discharge is not carried at the transfer portion Tr1. In this embodiment, an error range was set at ±0.3 μA and a range of divergence from a current value proportional to the transfer voltage based on a resistance value of the transfer portion Tr1 is within ±0.3 μA is defined as the undischarge range.

Further, in the undischarge range, the transfer voltage Vp applied to the transfer roller 14 when the toner-image-for-measurement is transferred onto the intermediary transfer belt 81 is set (S3). In this embodiment, as shown in FIG. 9, a voltage of 100 V which is lower by 100 V than 200 V was set as the transfer voltage Vp.

The controller thereafter returns the voltage settings of the charging roller 11 and the developing sleeve 232 to those in a condition during the image formation (S4). During the image formation in this embodiment, the DC voltage for the charging roller 11 is −600 V, the DC voltage for the developing sleeve 232 is −500 V, and the voltage applied to the primary transfer roller 14 is 900 V.

The controller 100 sets, after image output of X-th sheet is performed under this condition, the DC voltage for the charging roller 11 at −600 V and the DC voltage for the developing sleeve 232 at −450 V (S5). The controller 100 forms, in an image interval between the X-th sheet and (X+1)-th sheet, the toner-image-for-measurement by forming the electrostatic image for the toner-image-for-measurement Q at the laser light intensity L=150 and then by developing the electrostatic image by the developing device 2 (S6).

The controller 100 transfers the toner-image-for-measurement Q onto the intermediary transfer belt 81 by applying the transfer voltage Vp=100 V, lower than the discharge start voltage, to the transfer roller 14 (S7), and measures a transfer current Ip(X) at this time (S8). Then, the controller 100 measures a density Dp(X) of the toner-image-for-measurement Q by the patch detecting sensor 31 (S9).

The controller 100 obtains the values Ip(X) and Dp(X) and calculates a value IP(X)/Dp(X) (S10).

The method for calculating the toner supply amount M(X+1) from Ip/Dp(X) is the same as that (equation (1)) described in Embodiment 1. Further, in the case where the developing efficiency is lowered and thus the image density is lowered in the process in which the toner charge amount Q/M is kept at a constant level, similarly as in Embodiment 1, the electrostatic image is adjusted by changing the laser light intensity to stably maintain the image density.

<Embodiment 3>

In Embodiments 1 and 2, the image forming apparatus in which the toner image formed on a single photosensitive drum is transferred onto the intermediary transfer belt was described. However, the present invention can also be carried out in an image forming apparatus of a tandem type in which a plurality of image forming portions are provided along the intermediary transfer belt and toner images for respective colors are transferred.

Further, the present invention can also be carried out in an image forming apparatus in which the toner image formed on the photosensitive drum is transferred onto an intermediary transfer drum. Further, the present invention can also be carried out in an image forming apparatus in which the toner image formed on the photosensitive drum is transferred onto a recording material carried on a recording material conveyance belt. In the image forming apparatus in which the toner image is transferred onto the recording material carried on the recording material conveyance belt, the toner image receiving member is replaced with the recording material conveyance member for carrying and conveying the recording material onto which the toner image is to be transferred. The transfer device transfers, during image formation, the toner image onto the recording material carried on the recording material conveyance member by using the first transfer voltage higher than the discharge start voltage.

Further, during non-image formation, the toner-image-for-measurement is formed on the image bearing member and is transferred onto the recording material conveyance member by the transfer device by using the second transfer voltage lower than the discharge start voltage. Then, on the basis of detection results of the first detecting portion and the second detecting portion, the supplying operation of the supplying means is controlled so that the transfer current amount per unit amount of the transferred toner falls within a predetermined range.

Further, in Embodiments 1 and 2, the obtained toner charge amount Q/M is used for only the toner supply control. However, through an operating panel, an operation in a measuring mode in which the toner charge amount Q/M is automatically measured is executed and then the obtained toner charge amount Q/M may also be displayed as a numerical value. In this case, a first detecting portion for detecting a transfer current when the toner image formed on the image bearing member is transferred onto the toner image receiving member by using the transfer voltage lower than the discharge start voltage and a second detecting portion for detecting the toner density of the toner image transferred on the toner image receiving member are provided.

Further, the controller 100 outputs, on the basis of detection results of the first detecting portion and the second detecting portion, the numerical value of the toner charge amount Q/M of the toner in the developing device 2 to the operating panel.

<Embodiment 4>

In Embodiments 1, 2 and 3, the electrostatic image for the toner-image-for-measurement Q was formed to calculate Ip/Dp and on the basis of a result of the calculation, the toner supply control was effected. In this method, as described in Embodiments 1 to 3, it is possible to carry out the toner supply control so that the toner charge amount Q/M becomes constant that there is the following problem.

In order to keep measurement accuracy, the values Ip and Dp are required to be large to some extent. For that purpose, the toner to be transferred is required to some extent. On the other hand, in the conventional patch detection ATR control, the toner image is only required to be formed only at a place where the patch detecting sensor is provided, so that the amount of the toner used is small. When the electrostatic image for the toner-image-for-measurement Q is formed and a frequency of calculation of Ip/Dp is decreased, a degree of the influence of the toner use amount becomes small but correspondingly the toner charge amount Q/M is deviated from the constant value.

In this embodiment, a method in which the amount of the toner used in the control is reduced while maintaining the effect of the constant toner charge amount Q/M in Embodiments 1 to 3 will be described.

In the conventional patch detection ATR control, in the case where the patch density is changed, discrimination as to whether the toner charge amount Q/M is changed or the developing efficiency is changed cannot be made but the amount of the toner used in the control is small. On the other hand, in the method in Embodiments 1 to 3, the change in toner charge amount Q/M can be discriminated by the change in Ip/Dp but the amount of the toner used in the control is large.

The developing efficiency is gradually changed as also shown in FIG. 5 and therefore even when a frequency of checking of the change in developing efficiency is decreased, a large deviation is not generated.

The change in developing efficiency can be discriminated by a relationship between "patch density detected in the conventional patch detection ATR control" and "Ip/Dp calculated in Embodiments 1 to 3". For example, in the case where "patch density detected in the conventional patch detection ATR control" is low and the value "Ip/Dp calculated in Embodiments 1 to 3" is a desired value, it is possible to make discrimination that the developing efficiency is lowered.

In this embodiment, a developing efficiency calculating step for calculating a "estimated developing efficiency" from the values of "patch density detected in the conventional patch detection ATR control" and "Ip/Dp calculated in Embodiments 1 to 3" is provided. In addition, in the toner supply control, the developing efficiency calculating a step in which the toner supply amount is determined, by using the patch density calculated in the conventional patch detection ATR control and the estimated developing efficiency, so that "patch density/estimated developing efficiency" becomes constant, and the "estimated developing efficiency" is calculated every predetermined number of sheets is carried out.

When the frequency of the developing efficiency calculating step is decreased, the amount of the toner used in the control can be suppressed and the change in developing efficiency can also be grasped, so that the effect of the constant toner charge amount Q/M can also be maintained even by the conventional patch detection ATR control.

That is, the CPU as the controller compared a target density and the patch density detected with predetermined timing and then the toner supply control is effected so that the patch density is equal to the target density as in the conventional patch detection ATR control. The patch image at this time is transferred by the transfer voltage higher than the discharge start voltage.

On the other hand, Ip/Dp is detected with predetermined timing, as in Embodiments 1 to 3, at a frequency lower than that in the conventional patch detection ATR control. In the case where a detection result of Ip/Dp is smaller than the target value, in order to increase triboelectric charge, the target density in the patch detection ATR control is corrected so as to be decreased. On the other hand, in the case where the detection result of Ip/Dp is larger than the target value, in order to decrease the triboelectric charge, the target density in the patch detection ATR control is corrected so as to be increased.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 190721/2011 filed Sep. 1, 2011, which is hereby incorporated by reference.

What is claimed is:

1. An image forming apparatus, comprising:

an image bearing member;

a developing device for developing a latent image, formed on said image bearing member, into a toner image;

a supplying device for supplying a developer to said developing device;

a toner image receiving member onto which the toner image formed on said image bearing member is to be transferred;

a transfer member, provided at a position opposing said image bearing member via said toner image receiving member, to which a bias for transferring the toner image formed on said image bearing member is to be applied;

a bias applying device for applying the bias to said transfer member;

a current detecting circuit for detecting a current passing through said transfer member; and a controller for executing an operation in a mode in which a supply amount of said supplying device is controlled on the basis of information on a current Ip passing through said current detecting circuit when a predetermined toner image formed on said image bearing member is transferred onto said toner image receiving member and on the basis of a toner amount per unit area Dp of the predetermined toner image transferred on said toner image receiving member, wherein said controller controls the bias to be applied to said transfer member so that the bias is less than a discharge start voltage during the operation in the mode and so that the bias is greater than the discharge start voltage during image formation.

2. The apparatus according to claim 1, wherein said controller determines the bias, during non-image formation, to be applied to said transfer member during the operation in the mode on the basis of a detection result of said current detecting circuit when plural different biases are applied to said transfer member.

3. The apparatus according to claim 1, wherein said controller controls the supply amount of said supplying device on the basis of a ratio Ip/Dp.

4. The apparatus according to claim 1, wherein said toner image receiving member is an intermediary transfer member, and wherein the toner image transferred on said intermediary transfer member is transferred onto a recording material.

* * * * *